United States Patent [19]

Takata et al.

[11] 3,947,142

[45] Mar. 30, 1976

[54] ARTICULATED PAVEMENT COMPACTING MACHINE

[75] Inventors: Harry H. Takata, Golden Valley; Norman A. Bauer, Watertown, both of Minn.

[73] Assignee: Raygo, Inc., Minneapolis, Minn.

[22] Filed: Feb. 6, 1975

[21] Appl. No.: 547,731

[52] U.S. Cl. ..... 404/126

[51] Int. Cl.[2] ..... E01C 19/26

[58] Field of Search ..... 404/122, 124, 125, 126

[56] References Cited

UNITED STATES PATENTS

| | | | |
|---|---|---|---|
| 1,369,977 | 3/1921 | McLaren | 404/126 |
| 2,132,107 | 10/1938 | Hamm | 404/126 |
| 3,119,313 | 1/1964 | Neidhardt | 404/125 |
| 3,183,804 | 5/1965 | Le Tourneau | 404/121 |
| 3,229,602 | 1/1966 | Vivier | 404/126 |
| 3,416,419 | 12/1968 | Kronholm | 404/122 |
| 3,683,763 | 8/1972 | Keppler | 404/123 X |
| 3,868,194 | 2/1975 | Ferguson | 404/126 |

*Primary Examiner*—Nile C. Byers

[57] ABSTRACT

A tandem drum-type pavement compacting machine having front and rear drums journaled in substantially identical yokes, each of which is connected with the chassis of the machine for steering rotation about a vertical axis which intersects the axis of its respective drum midway of its axial width, and wherein the front end portion of the chassis to which the yoke of the front drum is steerably connected, is joined to the main section of the chassis by a trunnion or swivel connection that provides for relative oscillation or rocking motion between the front and rear drums about a horizontal axis extending fore and aft along the centerline of the machine and intersecting the vertical steering axes of the drums. An operator's platform is fixed with respect to the yoke of the rear drum and overlies the rear portion of the main section of the chassis.

10 Claims, 8 Drawing Figures

10
11
12
13
14
15
16
17
19R
19F
20
21
22
23
24
30
31
32
a

Fig. 2.
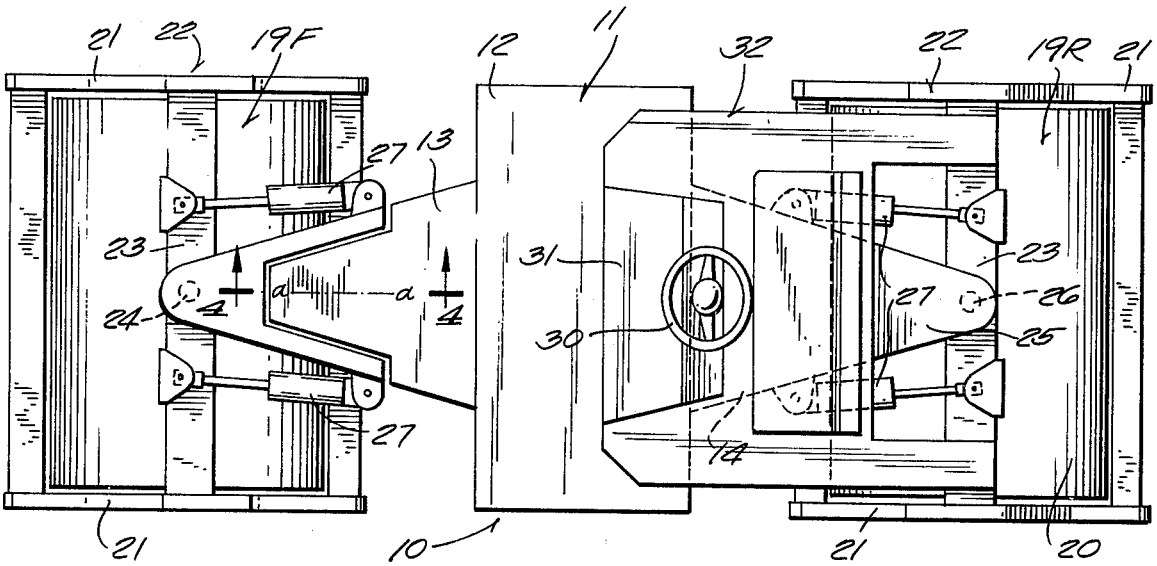
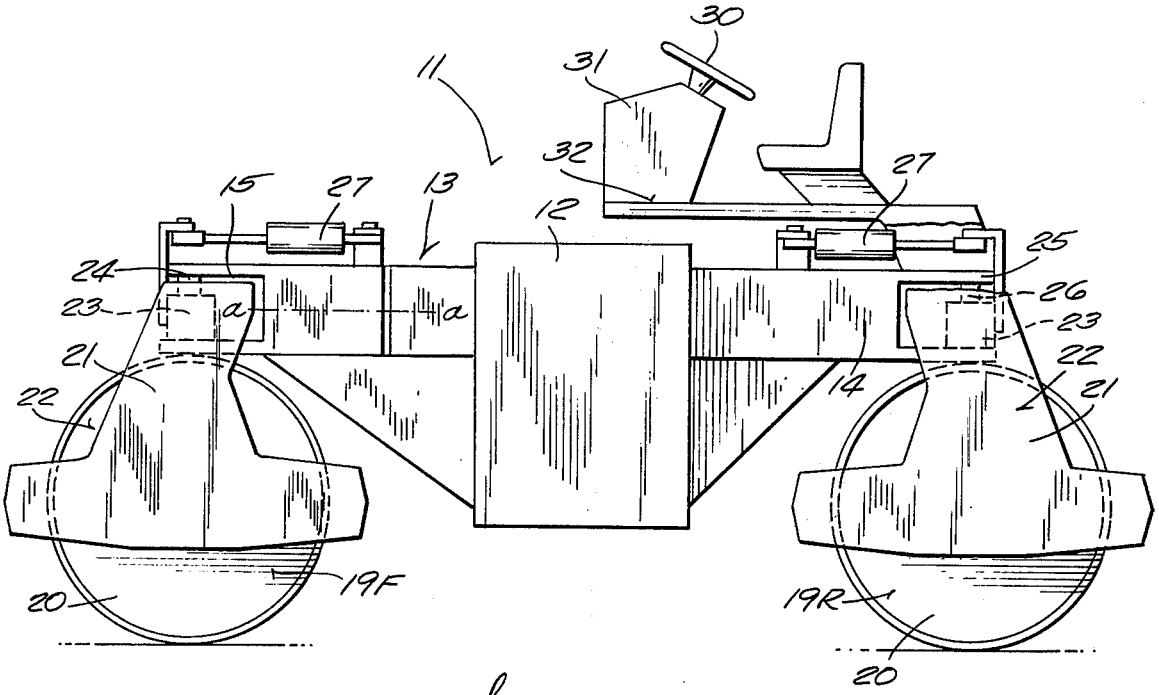
Fig. 3

Fig. 5
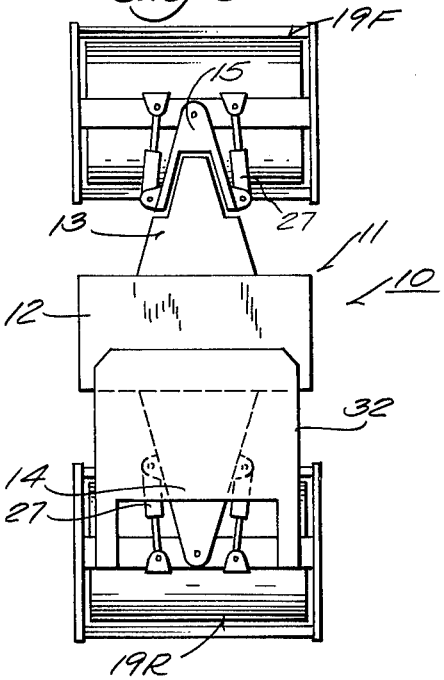
Fig. 7
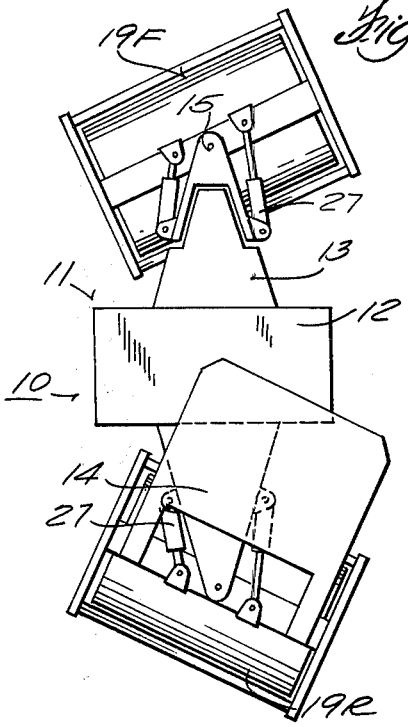
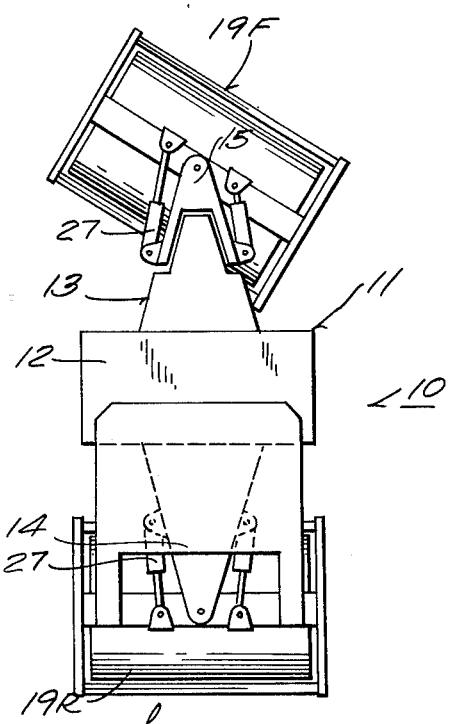
Fig. 6
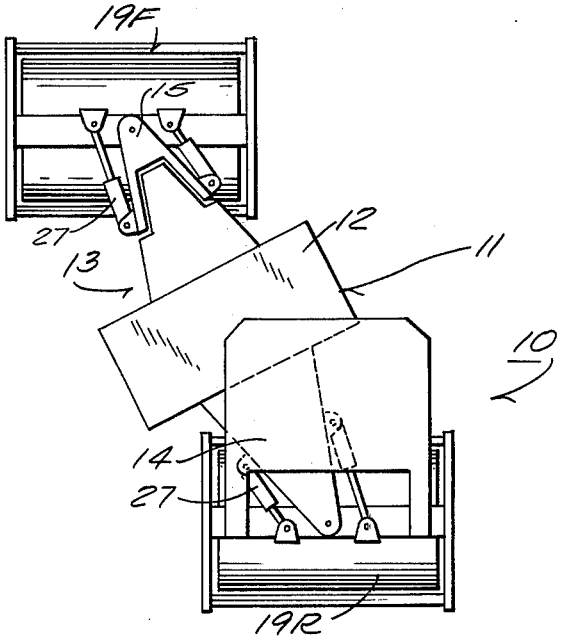
Fig. 8

ARTICULATED PAVEMENT COMPACTING MACHINE

This invention relates to roller type compacting machines and refers more particularly to pavement rolling machines having front and rear drums that are individually driven and mounted on the chassis of the machine in a manner which enables the drums to be moved from a conventional tandem disposition to an offset, though parallel, relationship. The invention is therefore generally classifiable with such prior art as the Kaltenegger U.S. Pat. No. 3,403,610 and the earlier Hamm U.S. Pat. No. 2,132,107.

The capability of offsetting the drums enables the machine — in one pass — to roll widths of pavement substantially twice as wide as the axial dimension of the drums and of course, any intermediate width. This is an important advantage, especially in rolling thin overlays of asphaltic material. such material cools to a critical temperature rather quickly — hence, the initial "breakdown" rolling pass must be made as soon as possible after the paver has laid the paving material in place. Since modern pavers are quite wide and simultaneously place the paving material across several traffic lane widths, a roller capable of spanning a width of pavement twice as wide as the width of its drums is indeed a welcome tool for the paving contractor.

While the machines of the aforesaid Kaltenegger and Hamm patents possess the drum-offsetting capability, they do not have the flexibility needed in finishing crowned pavement surfaces or surfaces otherwise not lying in a flat plane. This invention provides that flexibility by connecting the yoke of the front drum with the chassis of the machine through a horizontally disposed trunnion or pivotal connection the axis of which extends fore and aft along the centerline of the machine. As a result the front drum can oscillate or rock relative to the chassis and the rear drum.

In addition, because of a novel chassis design and the way in which the drums are steerably connected with the chassis, the weight of the chassis is borne equally by the two drums and distributed evenly across the width of each drum at all steering angles and all relative positions of the drums. This important advantage insures even compactive effort across the face of the drums in contact with the pavement surface.

A very important requirement in a pavement finishing roller is good visibility from the operator's station of the pavement being compacted and the area immediately surrounding the machine so that critical maneuvers can be performed without sacrificing the quality of work being done. To the attainment of that objective, this invention has the operator's platform rigidly mounted on the yoke of the rear drum and projecting forwardly therefrom to overlie the main frame. As a result, the operator's station is at a desirably high elevation and forward of the rear drum, where it provides an excellent vantage point from which everything requiring observation during handling and operation of the machine can easily be seen.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims. , The accompanying drawings illustrate one complete example of the embodiment of the invention constructed according to the best mode so far devised for the practical application of the principles thereof, and in which:

FIG. 2 is a top plan view of the machine;

FIG. 3 is a side view of the machine with a portion thereof broken away and in section;

FIGS. 5 through 8 are diagrammatic top views of the machine with its front and rear drums in different relative positions to show the versatility of the machine.

Figures 1, 4:
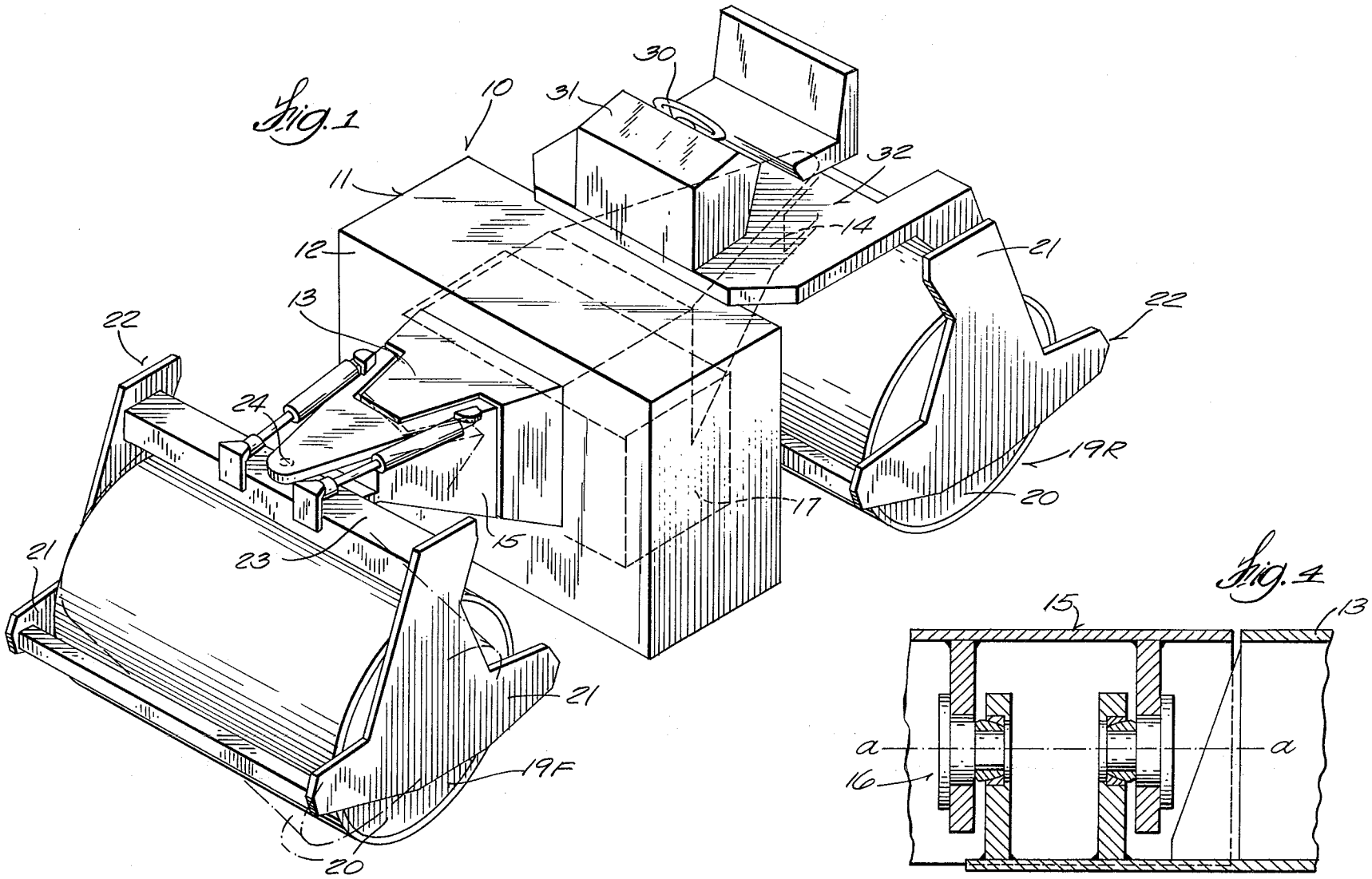
FIG. 1 is a perspective view of the variable width pavement rolling or compacting machine of this invention.
FIG. 4 is a detail sectional view through FIG. 2 on the plane on the line 4—4.

Referring to the accompanying drawings, the numeral 10 identifies the chassis of the compacting machine of this invention. It consists of a main section 11 having a mid portion 12 and forwardly and rearwardly projecting arms 13 and 14, respectively, and a front section 15 which is connected with the main section by a trunnion or pivot 16 (see FIG. 4) the axis a—a of which is horizontal and extends fore and aft along the centerline of the machine. A significant feature of the chassis is the symmetry of its design and construction about the longitudinal centerline of the machine. As will be brought out hereinafter, that symmetry and the manner in which the drums are connected with the chassis makes it possible to distribute the weight of the chassis equally between the two drums and evenly across the width of each drum regardless of the relative disposition of the drums.

The main chassis section is conveniently made as a hollow weldment. Its mid portion 12 contains the power unit of the machine, diagrammatically depicted as at 17 in FIG. 1, and mounted in its forwardly projecting arm 13 is the trunnion 16 and the fuel tank (not shown) for the engine of the power unit.

Substantially identical front and rear roller units 19F and 19R respectively are connected with the forwardly and rearwardly projecting arms of the chassis. Each roller unit consists of a drum 20 rotatably mounted between the arms 21 of a yoke 22, the cross bar 23 of which extends across the top of the drum and is longitudinally bisected by a vertical plane containing the axis of the drum. Like the main section of the chassis, the cross bars are preferably hollow weldments.

The cross bar of the front yoke is embraced by the arms of the clevis-like extremity of the front chassis section 15 and is connected thereto by a pivot 24, the axis of which perpendicularly intersects the axis of the drum and is symmetrically disposed with respect to the drum. Similarly the cross bar of the rear yoke is embraced by a clevis-like extremity 25 of the rearwardly projecting arm 14 of the main section of the chassis and is connected thereto by a pivot 26, the axis of which perpendicularly intersects that of the drum and is symmetrically disposed with respect to the drum.

As will no doubt be evident, the pivots 24 and 26 by which the roller units are connected with the chassis provide steering axes about which the roller units can be rotated independently of one another. By virtue of the symmetrical design of the chassis, these steering axes intersect the longitudinal centerline of the machine and the axis of the trunnion 16. This intersecting relationship of these axes, together with the fact that the center of gravity of the chassis is equi-spaced from the steering axes, and the symmetrical disposition of the steering axes with respect to the drums enables the weight the chassis to be borne equally by the two drums and evenly distributed across the full width of the drums.

The freedom of the chassis sections to rock with respect to one another provided by the pivotal connection 16, enables the front drum to assume whatever position the contour of the surface being traversed requires, while the rear drum is held rigid with respect to the chassis to provide chassis stability while maintaining even weight distribution and flexibility between the front and rear drums. This freedom of the drums to tilt with respect to one another gives the machine the flexibility needed in finishing crowned pavement surfaces with the drums offset as shown in FIG. 8 and at opposite sides of the crown. It also acommodates, without stressing any part of the machine, such transport situations wherein, for instance, an edge of one of the drums encounters a bump in the surface being traversed causing that drum to tilt while the other drum remains in a normal untilted position.

The independent steerability of the front and rear drums illustrated in FIGS. 6, 7 and 8 gives the machine fine maneuverability.

For conventional steering as when compacting an essentially straight pavement, either with the drums following one another in tandem or offset to a desired wider rolling width, only the front drum need be steered, as shown in FIG. 6.

For "crabbing" or oblique movement of the machine to offset the drums and increase the rolling width, as shown in FIG. 8, both drums are steered in the same direction and through the same angle with respect to the chassis.

For a tight steering radius and to maintain constant drum tracking or rolling width around curved pavements, both drums are steered but in opposite directions with respect to the chassis, as shown in FIG. 7.

To effect the steering of the drums, a pair of hydraulic rams 27 connects the cross bar of each drum yoke with pivot points fixed with respect to the adjacent one of the arms 13–14 of the main section of the chassis, one at each side thereof and symmetrically disposed with respect to the centerline of the machine. Extension of one of a pair of rams coincident with retraction of its mate imparts the desired steering torque; and as will be readily understood, the extension and retraction of the rams is effected by regulating the connection of the opposite ends of their cylinders with a source of hydraulic pressure derived from a pump which forms part of the power unit of the machine. That power unit comprises the customary engine, three hydraulic variable displacement pumps, the fuel tank 18, a reservoir for hydraulic fluid, and a water tank and pump for wetting the drums to prevent the adhesion of asphalt thereto. All of these items are conventional and hence have not been illustrated beyond the diagrammatic identification in FIG. 1 of the power unit.

Each drum has its own hydrostatic drive powered by one of the pumps of the power unit, and each is equipped with a variable amplitude vibration system. To isolate the vibration of the drums from their respective yokes when their vibration systems are operative, the bearings in which the drums are journaled are shock-mounted on the yokes. However, since those features form no part of this invention, they are not illustrated in the drawings. Moreover, they are fully disclosed and explained in the Barrett et al U.S. Pat. No. 3,814,532, and the Takata U.S. Pat. No. 3,909,147, which are assigned to the assignee of this invention.

The various controls including a steering wheel 30, by which operation of the machine is controlled, are located on a console 31 on the operator's platform 32. The location of that platform is unique. It is rigidly fastened to the rear yoke and, as shown, projects forwardly over the rearwardly projecting arm of the main section of the chassis. This elevated location of the platform and its fixed relationship with respect to the rear drum rather than the chassis affords an excellent vantage point from which the operator has optimum visibility of the pavement being compacted and the area immediately surrounding the machine, no matter what the relative disposition of the drums might be. Hence, the operator can handle the machine far more capably than was possible in prior machines of this type wherein the operator's station was on the chassis.

Those skilled in the art will appreciate that the invention can be embodied in forms other than as herein disclosed for purposes of illustration.

The invention is defined by the following claims:

1. A surface compacting machine of the type having individually and separately steerable front and rear drums and a chassis supported by said drums, characterized in that:

A. the chassis comprises a main section and a front section and means connecting said sections for and constraining them to rocking motion relative to one another about a horizontal axis that extends fore and aft of the machine;

B. a front yoke embracing the front drum and a rear yoke embracing the rear drum, each drum being freely rotatably connected to the arms of its yoke for rotation about the axis of the drum, and the crossbar of the yoke overlying the top of the drum;

C. front pivot means connecting the crossbar of the front yoke with the front section of the chassis, to provide for steering motion of the front drum with respect to the chassis, said pivot means constraining all relative motion between the front yoke and the front section of the chassis to rotation about an axis that is fixed with respect to the front section of the chassis and perpendicularly intersects the axis of the front drum symmetrically thereof, and also intersects said fore and aft horizontal axis;

D. rear pivot means connecting the crossbar of the rear yoke with the main section of the chassis to provide for steering motion of the rear drum with respect to the chassis, said rear pivot means constraining all relative motion between the rear yoke and the main section of the chassis to rotation about an axis that is fixed with respect to the main section of the chassis and perpendicularly intersects the axis of the rear drum symmetrically thereof, and also intersects said fore and aft horizontal axis; and E. separate operator controlled power steering means for imparting steering motion in either direction to each of the drums independently of one another or simultaneously, whereby said drums can be disposed with their axes at different angles with respect to one another and also in laterally offset relationship with their axes parallel, said power steering means being operatively connected with and reacting between each of said yokes and the chassis section to which it is connected, so that said power steering means does not interfere with the freedom of the drums to rock with respect to one another about said fore and aft horizontal axis.

2. The surface compacting machine of claim 1. wherein said power steering means comprises extensible and contractible hydraulic rams at opposite sides of said fore and aft horizontal axis, each having one end thereof connected at a fixed point to a crossbar and its other end connected at a fixed point to its chassis section, so that the distance between the fixed points of connection of said rams with their respective chassis sections and yokes is not affected by relative rocking of the chassis sections about said fore and aft horizontal axis.

3. The surface compacting machine of claim 1, further characterized by:

an operator's platform fixed with respect to the rear yoke and projecting forwardly from said yoke at an elevation no less than that of its crossbar, so that an operator stationed on said platform at all times has a clear view of the location of the rear drum with respect to an edge or other predetermined line along the surface over which said drum is travelling.

4. The surface compacting machine of claim 3, further characterized by:

said opertor's platform projecting forwardly from the crossbar of the rear yoke and overlying the main section of the chassis.

5. The surface compacting machine of claim 1, further characterized in that the main section of the chassis is a rigid structure having a mid-portion and forwardly and rearwardly projecting arms, the outer extremity of the rearwardly projecting arm forming a clevis that embraces the crossbar of the rear yoke and has the pivot means of paragraph D of claim 1 mounted therein.

6. The surface compacting machine of claim 5, wherein the front section of the chassis projects forwardly of the forwardly projecting arm of the main section of the chassis, wherein the means connecting said chassis sections for rocking motion relative to one another is a trunnion on the forwardly projecting arm of the mid-portion of the main section and on the front chassis section, the axis of which lies on the longitudinal center line of the machine, and wherein the front chassis section comprises a clevis embracing the crossbar of the front yoke.

7. The surface compacting machine of claim 4, wherein the mid-portion of the main section of the chassis and its forwardly and rearwardly projecting arms are symmetrically disposed in the horizontal direction with respect to the axis of said trunnion.

8. The surface compacting machine of claim 7, wherein said trunnion is located in said forwardly projecting arm of the main section of the chassis.

9. The surface compacting machine of claim 5, wherein the mid-portion of the chassis has the power unit of the machine mounted therein.

10. The surface compacting machine of claim 9, wherein the forwardly projecting arm of the main section of the chassis contains the fuel tank for the engine of the power unit.

* * * * *